United States Patent [19]

Hurni

[11] 4,184,266

[45] Jan. 22, 1980

[54] SINGLE BEAM REFERENCE SYSTEM FOR RAILWAY SURVEYING

[75] Inventor: Hans Hurni, Ecublens, Switzerland

[73] Assignee: Canron, Inc., New York, N.Y.

[21] Appl. No.: 836,223

[22] Filed: Sep. 23, 1977

[51] Int. Cl.[2] ..... E01B 35/08

[52] U.S. Cl. ..... 33/287; 33/338

[58] Field of Search ..... 33/287, 338

[56] References Cited

U.S. PATENT DOCUMENTS

| | | | |
|---|---|---|---|
| 3,750,299 | 8/1973 | Plasser et al. | 33/287 |
| 3,775,859 | 12/1973 | Sauterel | 33/338 |

FOREIGN PATENT DOCUMENTS 1209453 10/1970 United Kingdom .

*Primary Examiner*—Steven L. Stephan

*Attorney, Agent, or Firm*—Wenderoth, Lind & Ponack

[57] ABSTRACT

A railway surveying apparatus is disclosed. The apparatus has a light beam transmitter for transmitting a beam along the track, a light beam receiver and an intermediate shadow board all mounted on respective rail-engaging buggies so that the transmitter, receiver and board are located on the center line of the track. The shadow board and receiver buggies are connected through a twist transducer that measures the relative angular positions of the buggies. A pendulum is mounted on the receiver buggy and serves to measure the actual rail cross level condition at that point. A pendulum on the transmitter buggy and appropriate circuitry can reference the apparatus to either the track center line or one of the rails.

24 Claims, 6 Drawing Figures

SINGLE BEAM REFERENCE SYSTEM FOR RAILWAY SURVEYING

FIELD OF THE INVENTION

This invention relates to railroad track surveying apparatus.

BACKGROUND OF THE INVENTION

In Canadian Pat. No. 762,044 to John Stewart and Helmuth R. E. von Beckmann issued June 27, 1967 there is described a railway track surveying apparatus comprising a light frequency beam transmitter mounted for movement along a track and for transmitting a light frequency beam substantially longitudinally of the track. A pair of beam receivers are provided, one for each rail of the track, mounted for movement along the track in spaced relationship to the transmitter within the transmitted beam, a shadowboard for each receiver is mounted for movement along the track and located intermediate the transmitter and receivers and substantially nearer to the receivers than to the transmitters, means is provided for adjusting the vertical height of the receivers, controlled by a gravity sensing means, so that the vertical height of a selected one of the receivers may be adjusted to maintain the receivers in cross level relative to the grade rail.

The present invention is concerned with improvements in systems of this type.

SUMMARY OF THE INVENTION

According to one aspect of the present invention there is provided a method for surveying a railway track comprising: providing a reference line along the track from a leading station to a trailing station; determining vertical deviations in the track level at an intermediate station, by reference to the reference line; determining the cross level condition of the track at the trailing station and determining the difference between the track cross level conditions at the intermediate and trailing stations.

The invention also provides a railway track surveying apparatus including: means providing a reference line along the track from a leading station to a trailing station; means for determining vertical deviations in the track level at an intermediate station; means for determining the cross level conditions of the track at the trailing station and means for determining the difference between the track cross level conditions at the intermediate and trailing stations;

Preferably, the reference line is a light frequency beam from a transmitter mounted for movement along the track, substantially above the centerline thereof to a receiver mounted for movement along the track, substantially above the centerline thereof. Beam interference means is mounted for movement along the track for following vertical deviations in the track level and intercepting at least a portion of the beam so as to vary the portion thereof received by the receiver.

The use of a single transmitter, a single receiver and a single beam interference means, normally a shadow board, on the track centerline permits the use of the present apparatus in places where limited available space would prevent the use of prior devices.

By determining the cross level condition of the track at the trailing station and the difference between the cross level conditions at the trailing and intermediate stations, the actual cross level conditions at the intermediate station can be determined without employing a gravity sensitive element located at the intermediate station. This is desirable because the apparatus will normally be employed in conjunction with a track jacking and ballast tamping apparatus, the operation of which could produce rather violent movements in the portion of the apparatus at the intermediate station.

The means for determining the difference between the track cross level conditions at the intermediate and trailing stations preferably includes a twist transducer connected between two buggies mounted on the track rails at respective ones of the stations.

According to another aspect of the present invention, there is provided in a railway track surveying apparatus of the type comprising a light frequency beam transmitter mounted for movement along a track, for transmitting a beam along the track; receiver means mounted for movement along the track at a position spaced from the transmitter for receiving at least a portion of the beam; beam interference means mounted for movement along the track at a position between the transmitter and the receiver; and means for determining the cross level condition of the track at the interference means, the improvement comprising control means for controlling operation of the apparatus, and including means for selecting one or the other of the track rails or the track centerline as a datum line for the determination of the levelling of the rails, and means for adjusting the relative heights of the transmitter, the receiver and the beam interference means to compensate for the selection.

According to a further aspect of the present invention there is provided a method of levelling a railway track comprising: providing a reference line along the track from a leading station to a trailing station; determining vertical deviations in the track level at an intermediate station by reference to the reference line; and levelling the track at the intermediate station in accordance with the determined vertical deviations characterized by: selecting one rail of the track, or the track centerline, as a datum line; determining a rail reference point at the leading station on whichever of the track rails is for the time being higher than the other with respect to a selected cross level; and altering the level of the track at the intermediate station to bring the datum line at the intermediate station into a desired vertical position with respect to the rail reference point and a point on the datum line at the trailing station.

A still further aspect of the invention provides in a railway track levelling apparatus of the type comprising means for providing a reference line along the track from a leading station to trailing station; means for determining vertical deviations in the track at an intermediate station by reference to the reference line; and means for levelling the track at the intermediate station in accordance with the determined vertical deviations, the improvement comprising: control means for controlling operation of the apparatus, including means for selecting a datum line following the longitudinal contour of the track; means for determining a rail reference point at the transmitter on whichever of the track rails is for the time being higher than the other with respect to a selected cross level condition; and means for altering the level of the track at the intermediate station to bring the datum line at the intermediate station into a desired vertical position with respect to the rail reference point and a point on the datum line at the trailing station.

In a preferred embodiment, the reference line is provided by a light frequency beam transmitter at the leading station for transmitting a beam along the track, a receiver mounted at the trailing station for receiving at least a portion of the beam and beam interference means at the intermediate station for following vertical deviations in the track level and intercepting at least a portion of the beams so as to vary the portion of the beam received by the receiver. The datum line extends along one of the rails of the track, or along the centerline of the track. The means for selecting the datum line includes means for raising and lowering the interference means in accordance with the track cross level conditions at the leading and trailing stations and the desired cross level condition at the intermediate station. The track cross level conditions at the leading and trailing stations are measured by appropriate pendulums at those stations.

BRIEF DESCRIPTION OF THE DRAWINGS

In the accompanying drawings which illustrate an exemplary embodiment of the present invention.

DESCRIPTION OF A PREFERRED EMBODIMENT

Figure 1:
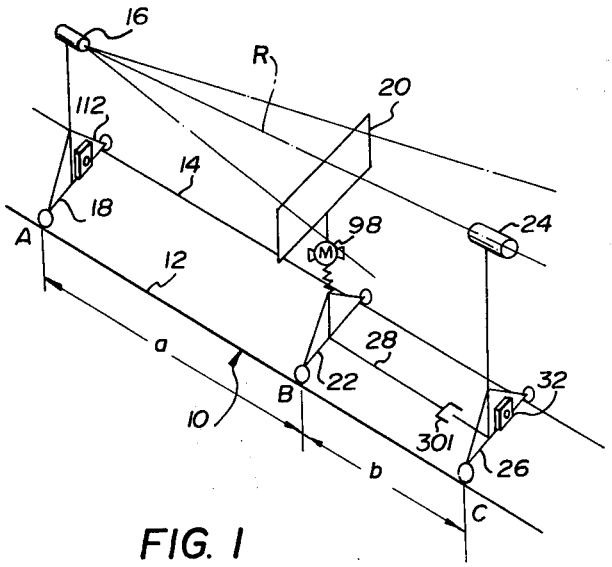
FIG. 1 is a schematic perspective view of a surveying apparatus in accordance with the invention.

Referring to the drawings, and particularly to FIGS. 1 to 5, there is illustrated a railway track 10 with parallel rails 12 and 14. Mounted on the rails at a leading station A is an infra-red light transmitter 16 for transmitting a beam of infra-red light along the track. As illustrated most particularly in FIG. 3, transmitter 16 is mounted on the top end of a standard 17 of a buggy 18 with flanged wheels 19 mounted on the rails 12 and 14 of track 10. The transmitter is located above an imaginary line 48 along track 10, midway between the rails 12 and 14 and intersecting with lines across the track on the tops of the rails. For the purposes of this specification, such a line may be referred to hereinafter as the track centerline. A pendulum 112 is mounted on the buggy 18 to generate a signal representing the cross level condition of the track at station A.

Figure 6:
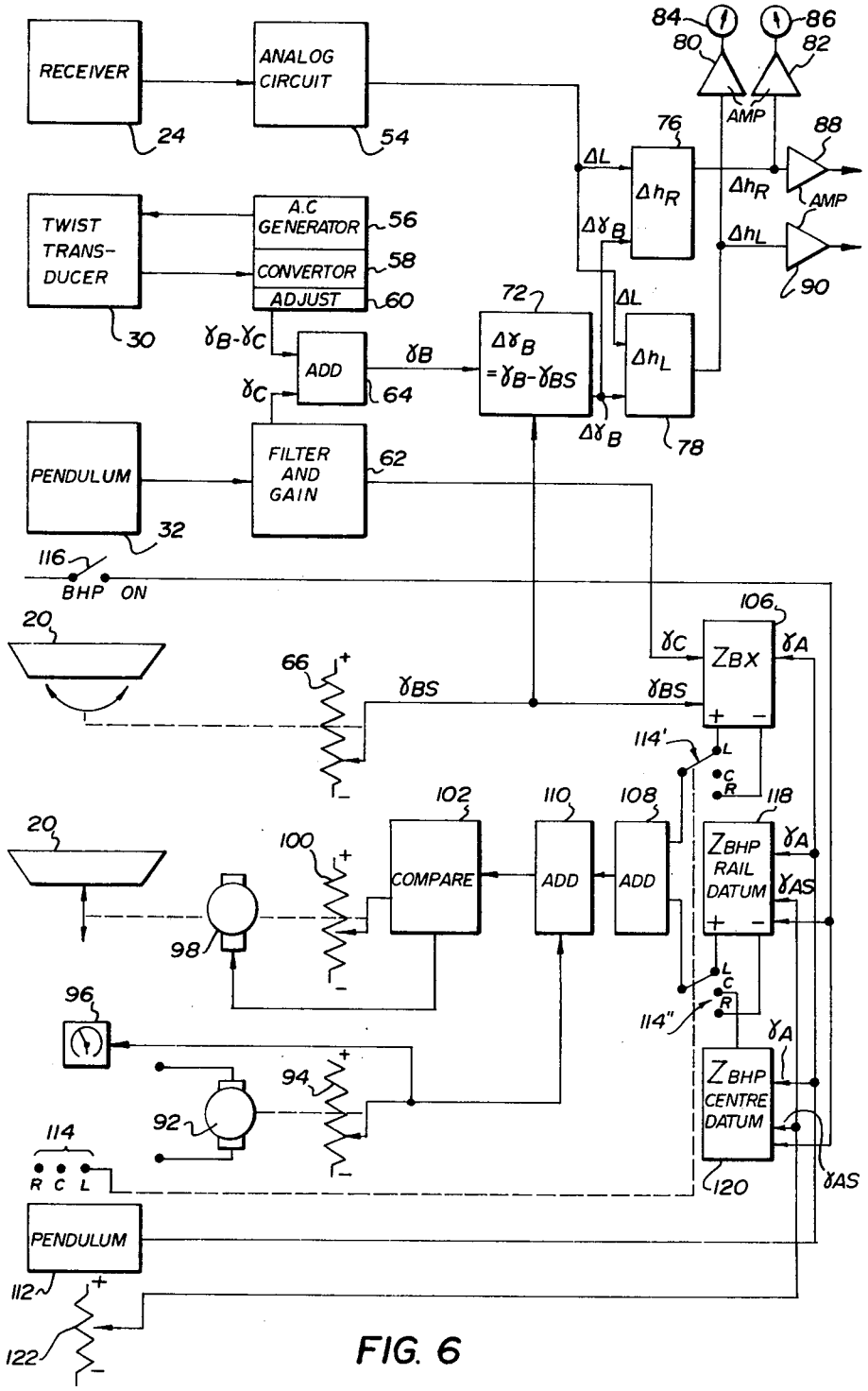
FIG. 6 is a schematic drawing of a control system, some elements of which are shown in FIGS. 1, 3, 4 and 5.

Spaced a distance "a" along the track from transmitter 16 is a shadow board 20 mounted on the upper end of a frame 21 of a buggy 22 with flanged wheels 23 supporting it on rails 12 and 14. As can be seen most readily from FIG. 4, the shadow board 20 is mounted on the top end of the frame 21 by an adjusting mechanism 25 that permits both vertical and side-to-side tilting adjustments of the board 20. This adjusting mechanism consists of a housing 35 mounted on the top of the frame 21, a jackscrew 34 projecting from the top of housing 35 and threaded into a rotatable nut (not shown) within the housing. The nut is driven by an electric motor 98 (FIGS. 1 and 6). A cylindrical housing 36 is secured to the upper end of the jackscrew 34 and is prevented from rotating with respect to housing 35 by a lug 37 sliding in a mating slot in an arm 39 projecting upwardly from housing 35. Housing 36 carries an arm 38 which extends upwardly from the housing 36 to a position centrally above the housings 35 and 36 and the jackscrew 34. At that position, the arm 38 is pivotally connected to the center of the shadow board 20 by a pivot 40.

Figure 4:
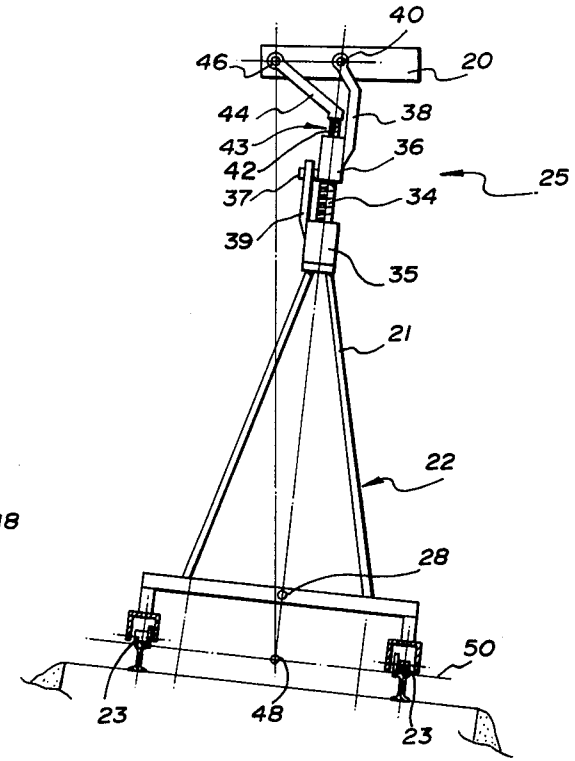
FIG. 4 is a view along IV—IV in FIG. 2.
Figure 3:
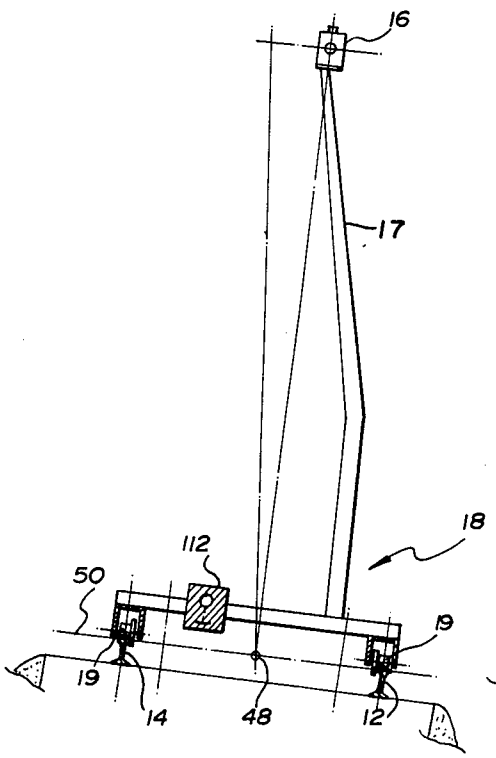
FIG. 3 is a view along line III—III in FIG. 2.

A further jackscrew 42 is threaded into housing 36, concentrically with screw 34. This second screw is threaded through a rotating nut in housing 36 (not shown) where it is coupled to a drive mechanism (not shown). The upper end of the jack screw 42 is fixed to an arm 44 which projects radially and upwardly to a position where it is pivotally and slidably connected to the shadow board 20 by a pivot pin 46. By driving the jackscrew 34, the entire assembly consisting of housing 36, arm 38, jack screw 42, arm 44 and shadow board 20 is lifted and lowered along the axis 27 of the adjustment mechanism. As will be understood, lifting and lowering of the shadow board 20 is this fashion does not alter its lateral tilt, that is its side-to-side orientation with respect to horizontal. Tilting of the shadow board is achieved by means of the jackscrew 42 which, when extended or retracted, pivots the shadow board 20 clockwise or counter clockwise about the pin 40. This tilting adjustment is used to orient the shadow board 20 horizontally in passing through curves where one of the rails is super-elevated in relation to the other. This is illustrated in FIGS. 3, 4 and 5 where the left rail is super-elevated in relation to the right.

Figure 5:
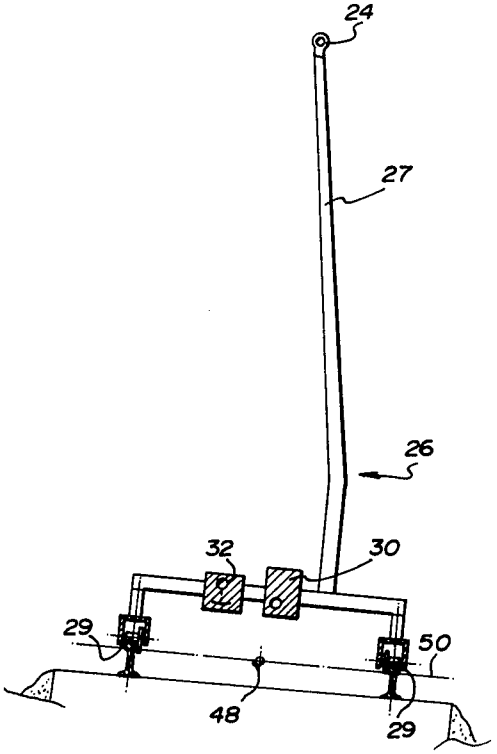
FIG. 5 is a view along V—V in FIG. 2.

As illustrated in FIGS. 1 and 5, an infra-red receiver 24 is positioned at a station C, a distance "b" along the track from the location of the shadow board at station B. The receiver 24 is mounted on the top end of a standard 27 of a buggy 26. The buggy has flanged wheels 29 mounting it on the rails 12 and 14 for movement therealong. The receiver 24 is positioned above the centerline 48 of the track, as are the shadow board 20 and the transmitter 16.

Returning to FIG. 1, there is a shaft 28 having one of its ends fixed to the buggy 22 at the intermediate station B and its other end coupled to a twist transducer 30 fixed to the buggy 26 at trailing station C. The transducer 30 is an inductive measuring feeler that measures the relative angular positions of the buggies to generate a signal representative of the difference between the track cross level conditions at the intermediate and trailing stations, B and C respectively. To determine the absolute cross level condition of the track at station C, the trailing buggy 26 carries a pendulum device 32 which produces a signal representative of the cross level condition at the trailing station C. As will hereinafter be discussed in somewhat greater detail, the signals from the pendulum 32 and the twist transducer 30 may be combined to determine the cross level at intermediate station B.

Figure 2:
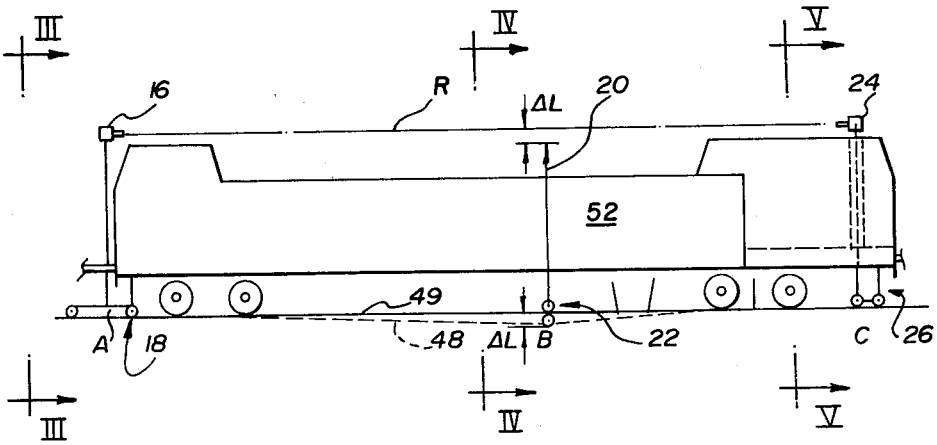
FIG. 2 is a schematic side elevation showing a surveying apparatus associated with a track jacking and ballast tamping machine.

FIG. 2 of the drawings illustrates the surveying apparatus associated with a track jacking and ballast tamping apparatus 52 of known configuration. The jacking and tamping tools (not illustrated) are located adjacent the buggy 22 supporting the shadow board 20 as is normal in the art.

FIG. 6 illustrates the control system for the apparatus. This will be described in conjunction with the operations that can be performed.

In operation, the quantity of the light transmitted by transmitter 16 that is received by the receiver 24 is represented by a signal produced by the receiver and supplied to an analog circuit 54 (FIG. 6) to produce a voltage in a manner similar to that of previous apparatus. The light quantity and therefore the voltage vary with the vertical position of the shadow board 20 with respect to a reference line R (FIG. 2) from the transmitter 16 to the receiver 24. Because the shadow board 20 is carried by the buggy 22 which rides on rails 12 and 14 to sense vertical deviations in the track level, variations in its vertical position are presentative of the vertical deviations of the track level at station B. Thus, the voltage from circuit 54 may be used to represent the vertical deviation (ΔL, FIG. 2) of the actual track centerline 48 at station B from a datum centerline 49 from the front buggy 18 to rear buggy 26, parallel to reference line 17. If no deviation exists, then the voltage is zero. The direction of the deviation is given by the polarity of the voltage.

As will be apparent, adjustment of the shadowboard 20 ensures that the measured deviations (ΔL) will have the proper value for the existing position of the track. To provide for vertical adjustment of the shadow board a manual switch (not shown) is used to operate a small electric motor 92 (FIG. 6) to rotate a potentiometer 94 to produce a voltage representative of the desired vertical position of the shadowboard relative to the track at station B. A lift dial 96 indicates this value.

The voltage from potentiometer 94 is used to adjust the shadowboard. The adjustment is done by another electric motor 98 which is connected through a flexible shaft to the screw 34 of the shadowboard 20. The motor 98 is connected to a potentiometer 100, to produce a voltage output representative of the actual position of the shadowboard. This output is constantly compared with the voltage from potentiometer 94 in circuit 102. This latter voltage is supplied to circuit 102 via adder 110, the function of which will be subsequently described. The shadowboard motor 98 is controlled by the output of circuit 102 so as to follow the desired adjustment.

When the apparatus is used in conjunction with a track jacking and ballast tamping machine (FIG. 2) the station B, as previously noted is adjacent the position where the track level is to be corrected. The quantity ΔL therefore indicates the magnitude of the vertical correction to be made. The buggy 26 at station C rides on corrected track and the buggy 18 at station A is sufficiently far forward of station B that track errors at station A can be neglected and therefore, errors in the vertical height of transmitter 16 have an insignificant effect on the vertical position on the reference line R at station B.

The pendulum 32 on the buggy 26 delivers instantly and directly a voltage in accordance with the existing cross level condition to a filter and gain circuit 62 (FIG. 6) which generates a voltage representing the cross level condition at station C ($\gamma_C$). At the exact horizontal cross level condition this voltage is zero. In other cases, the direction of super elevation will be indicated by the polarity.

Twist tranducer 30 is an inductive measuring feeler. It is supplied with an AC voltage from generator 56. This voltage is modulated by the transducer and subsequently supplied to converter 58 where it is converted to a DC signal. This signal is adjusted by circuitry 60 to produce a voltage signal proportional to the twist of the track between stations B and ($\gamma_B-\gamma_C$). This may also be referred to as the difference between the track cross level conditions at stations B and C. Should there be no twist, then this voltage is zero, if there is any twist then its direction will be indicated by the polarity of the voltage.

A voltage representative of the cross level condition of the track at station B ($\gamma_B$) is generated by supplying the voltages representing $\gamma_C$, the cross level condition at station C, and $\gamma_B-\gamma_C$, the difference in the cross level conditions at stations B and C to the electronic adder 64 which produces an output representative of: $\gamma_B=\gamma_C+\gamma_B-\gamma_C$.

From the above description it will be seen that the voltage representative of $\gamma_B$ will be zero if the track at station B is horizontal and also that the direction of the super-elevation, if any, can be identified by the polarity of the voltage.

A potentiometer 66 (FIG. 6) is connected to the jackscrew 42 and housing 36 of shadowboard adjustment mechanism 25 to produce a voltage signal representative of the side-to-side tilt applied to the shadowboard. This tilt is equal in magnitude and opposite in sense to the desired superelevation ($\gamma_{BS}$) at station B so that under the desired cross level conditions, the shadowboard will be horizontal. Consequently, the voltage signal from potentiometer 66 represents the desired cross level condition at station B, $\gamma_{BS}$. This voltage will ideally be zero if there is zero desired superelevation. The direction of superelevation is again indicated by the polarity of the voltage.

The voltages representing $\gamma_B$ and $\gamma_{BS}$, are supplied to the electronic sub-traction or summation element 72 to obtain a voltage representing the error ($\Delta\gamma_B$) between the desired and existing cross level conditions at station B. The function performed by element 72 is $\Delta\gamma_B=\gamma_{BS}-\gamma_B$. Again, the voltage is zero if there is no error and, if there is any, then, the direction of such will be indicated by the polarity.

With the values $\Delta\gamma_B$ from element 72 and ΔL from analog circuit 54, it is possible to determine the error between the vertical position of the track from its desired position at station B. This information may be used to control the lifting cylinders of a track jacking and ballast tamping apparatus. The quantities $\Delta h_R$ and $\Delta h_L$, representing the magnitudes of the desired changes in elevation of the right and left rails respectively, are calculated electronically in circuits 76 and 78 respectively. The functions performed are:

$$\Delta h_R = \Delta L + \frac{\Delta\gamma_B}{2} \text{ and } \Delta h_L = \Delta L - \frac{\Delta\gamma_B}{2}.$$

The factor $\frac{1}{2}$ is introduced because the track centreline is used as a datum line with respect to which one rail will be raised and the other lowered to remove the cross level error $\gamma_B$. Each of voltages obtained (Δh) is equal to zero if the appropriate rail is in the exact desired position. Should there be an error, then the voltage indicates its magnitude and the polarity its sense.

Through calibration amplifiers 80 and 82, instruments 84 and 86 respectively will show the errors in the levels of the left and right rails respectively at station B in units of length, such as millimeters or inches.

Other calibration amplifiers 88 and 90 can be used to control directional valves (not shown) for a track lifting operation by the jacking cylinders.

The design of the apparatus with transmitter 16, receiver 24 and shadowboard 20 above the center of the track results in the centerline 48 between stations A and C being used as a datum or grade line for track levelling.

Should it be desired to use the right or left hand rail as a reference or grade rail, the shadowboard has to be adjusted vertically with respect to the transmitter and receiver to compensate for the fact that the points on the grade rail at stations A and C to which the grade rail position at station B is related, may be either higher or lower than the corresponding points on the centreline thus requiring a higher or lower lift to correct rail errors. The adjustment also compensates for the cross levelling of the track to the grade rail rather than the centerline. The magnitude of the adjustment is given by a parameter $Z_{BX}$. The formula for this value is $$Z_{BX} = \frac{1}{2}\left(\frac{b}{a+b}\gamma_A + \frac{a}{a+b}\gamma_C + \gamma_{BS}\right)$$

where:

$\gamma_A$ indicates the cross level condition at station A;

$\gamma_C$ indicates the cross level condition at station C;

$\gamma_{BS}$ indicates the desired or a set cross level condition at station B;

a is the distance from A to B and b is the distance from B to C.

$Z_{BX}$, $\gamma_A$, $\gamma_C$, and $\gamma_{BS}$, along with the other parameters of the same general nature can be considered as angles with respect to horizontal or elevation in linear dimensions above horizontal since the two are dependent upon and determine one another.

$\gamma_A$ is measured by the pendulum 112 carried by the transmitter buggy 18, $\gamma_C$ is measured by pendulum 32 on buggy 26 and $\gamma_{BS}$ is measured by shadowboard potentiometer 66, these elements generating appropriate voltage signals for use in the control system.

$Z_{BX}$ is calculated in circuit 106 and is fed via adder 108 to adder 110 with the outputs of potentiometers 94 to 100 to control shadowboard motor 98.

A selector switch 114 is operative to select one of two values of $Z_{BX}$, or zero, corresponding to the selection of:

1. The left rail as reference or grade rail. $Z_{BX}$ has its calculated magnitude and polarity.
2. The right rail as grade rail. $Z_{BX}$ has its calculated magnitude with reversed polarity.
3. The centerline of the track as a datum line. The $Z_{BX}$ value is zero.

The reversal of polarity from left to right rails is to be consistent with the use of voltage polarity to indicate the sense of a parameter represented by the voltage. In some cases it is an advantage to level a track to a reference point on the highest rail at the station A, for example, if only small lifts are required, if errors in the track are encountered, or in tracks with offset rail joints. In order to achieve this automatically, a "high point" control is used to monitor the cross level condition at station A and to adjust the vertical position of shadowboard 20 in accordance with those cross level conditions so that the higher rail is used as a grade rail at station A, while stations B and C refer to whichever of the rails or the centerline is selected as the datum line by switch 114. The "high point" control is switched on by switch 116. When this is done, a parameter $Z_{BHP}$ will be used as a shadowboard adjustment factor. This parameter is calculated as follows:

Where switch 114 is used to select either the left or right rail as a grade rail $$Z_{BHP} = \frac{b}{a+b}(\gamma_A - \gamma_{AS})$$

which is calculated by circuit 118. This value is used only if $\gamma_A$ is larger than $\gamma_{BS}$. That is, $Z_{BHP}$ will only be used if positive. $\gamma_{AS}$ is a reference cross level condition of the track at station A. A voltage representing this value is set by a potentiometer 122 and is supplied to circuits 118 and 120.

$\gamma_A$ is the actual cross level condition of the track at station A, as determined by pendulum 112, which generates a voltage representative of this condition for supply to circuits 118 and 120. Where the left rail is the grade rail, the calculated value is used directly and where the right rail is selected as the grade rail, the calculated value is used with reversed polarity, to ensure consistency with the voltage polarities employed.

If the centerline is selected as the reference line, circuit 120 is used to calculate $Z_{BHP}$ according to:

$$Z_{BHP} = \frac{1}{2}\ \frac{b}{a+b}\ |\gamma_A - \gamma_{AS}|.$$

The selector switch 114 has a second set of contacts 114" operative to select the desired value of $Z_{BHP}$ from circuits 118 and 120 and supply it to adder 108 for summation with the parameter $Z_{BX}$. That sum is added to the shadowboard adjustment voltage from potentiometer 94 in adder 110. The combined voltage is supplied to circuit 102 to control the shadowboard motor 98 in the manner described above with reference to motors 92 and 98 and potentiometers 94 and 100.

When the apparatus is used with the "high point" control and in conjunction with the track leveling machine, the track will be levelled at station B to bring the datum line, whether one of the rails or the centerline, into a desired vertical position with respect to the reference point on the high rail at station A and the datum line for the corrected rail at station C. The "high rail" at station A is which ever of the rails is for the time being higher than the other with respect to the selected cross level condition represented by $\gamma_{AS}$.

While the present invention has been described as using a light transmitter and a light receiver for generating the reference line R this line can be generated in various other ways, for example with other forms of radiation or even with a wire.

I claim:

1. A railway track surveying apparatus comprising a single transmitter for transmitting a light frequency beam mounted for movement along a track at a fixed lateral position relative to the rails for transmitting a beam along the track; a single receiver means mounted for movement along the track at a position spaced from the transmitter and at a fixed lateral position relative to the rails for receiving at least a portion of the beam; and a single beam interference means mounted for movement along the track at a position between the transmitter and the receiver, means for determining the cross levels of the track at the transmitter and the receiver; and control means for controlling operation of the apparatus, including means for selecting one or the other of the track rails or the track centerline as a datum line for the determination of the levelling of the rails and means for adjusting the height of one of the transmitter, the receiver and the beam interference means in dependance on the cross levels of the track at the transmitter and the receiver to compensate for the selection.

2. An apparatus according to claim 1 wherein the transmitter and receiver are substantially above the center line of the track.

3. Apparatus according to claim 2 wherein the beam transmitter is an infrared beam transmitter.

4. Apparatus according to claim 2 wherein the beam transmitter is mounted on a wheeled buggy for movement along the track.

5. Apparatus according to claim 2 wherein the beam transmitter is located on a line through the center line of the track, normal to its cross level.

6. Apparatus according to claim 2 wherein the receiver is mounted on a wheeled buggy for movement along the track.

7. Apparatus according to claim 5 wherein the receiver is located on a line through the center line of the track, normal to its cross level.

8. Apparatus according to claim 7 wherein the beam interference means is mounted on a second wheeled buggy for movement along the track.

9. Apparatus according to claim 8 including a twist transducer connected to the two buggies to determine the difference between the track cross levels at the interference means and the receiver.

10. Apparatus according to claim 9 wherein the means for determining the cross level at the receiver includes a gravity sensing means mounted on the buggy carrying the receiver.

11. Apparatus according to claim 2 wherein the beam interference means comprises a shadowboard.

12. Apparatus according to claim 11 including means for raising and lowering said shadowboard and means for tilting it from side to side.

13. Apparatus according to claim 10 wherein the means for determining the cross level of the track at the transmitter comprises a second gravity sensing means mounted on a buggy carrying the transmitter for determining the cross level of the track at the transmitter.

14. Apparatus according to claim 1 wherein the amount of the compensation is expressed by:

$$Z_{BX} = \frac{1}{2}\left(\frac{b}{a+b}\gamma_A + \frac{a}{a+b}\gamma_C + \gamma_{BS}\right)$$

Where:

$Z_{BX}$ is the compensation;

a is the distance from the transmitter to the interference means;

b is the distance from the interference means to the receiver;

$\gamma_A$ is the track cross level condition at the transmitter;

$\gamma_C$ is the track cross level condition at the receiver; and $\gamma_{BS}$ is the desired cross level condition at the interference means.

15. An apparatus according to claim 14 wherein the transmitter and receiver are substantially above the center line of the track.

16. Apparatus according to claim 15 wherein the beam interference means comprises a shadowboard.

17. Apparatus according to claim 16 including means for raising and lowering said shadowboard in accordance with the difference between the actual track cross level at the leading station and the selected cross level.

18. A railway track levelling apparatus of the type comprising a single means for defining a reference line along the track at a fixed lateral position relative to the track from a leading station to a trailing station; means for determining vertical deviations in the track at an intermediate station by reference to the reference line; means for levelling the track at the intermediate station in accordance with the determined vertical deviations, means for determining the cross level of the track at the leading station, control means for controlling operation of the apparatus, including means for determining a datum line following the longitudinal contour of the track; means for selecting a rail reference point at the leading station on whichever of the track rails is for the time being higher than the other with respect to a preselected cross level, and means operable in response to the rail reference point determining means and operably associated with said track levelling means for operating said track levelling means for altering the level of the track at the intermediate station to bring the datum line at the intermediate station into a desired vertical position intermediate the rail reference point and a point on the datum line at the trailing station.

19. Apparatus according to claim 18 including means for selecting one of the rails as a grade rail, said datum line being located on said grade rail.

20. An apparatus according to claim 18 wherein the means for determining the rail reference point include means for determining the actual track cross level at the leading station.

21. An apparatus according to claim 20 wherein the means for determining the rail reference point further include means for compairing the actual track cross level at the leading station with said selected cross level.

22. An apparatus according to claim 21 wherein the means providing a reference line is a light frequency beam transmitter at the leading station and a beam receiver at the trailing station, and the means for determining vertical deviations in the track comprise a beam interference means mounted on the track at the intermediate station to vary the portion of the beam received by the receiver in accordance with the vertical deviations in the track.

23. A method of levelling a railway track comprising: providing a reference line along the track from a leading station to a trailing station; determining vertical deviations in the track level at an intermediate station by reference to the reference line; and levelling the track at the intermediate station in accordance with the determined vertical deviations characterized by: selecting a rail reference point at the leading station on whichever of the trail rails is for the time being higher than the other with respect to a selected cross level; and altering the level of the track at the intermediate station to bring the datum line at the intermediate station into a desired vertical position with respect to the rail reference point and a point on the datum line at the trailing station.

24. A railway track surveying apparatus comprising a single transmitter for transmitting a light frequency beam mounted for movement along a track at a fixed lateral position relative to the rails for transmitting a beam along the track; a single receiver means mounted for movement along the track at a position spaced from the transmitter and at a fixed lateral position relative to the rails for receiving at least a portion of the beam; and a single beam interference means mounted for movement along the track at a position between the transmitter and the receiver; means for determining the cross levels of the track at the transmitter and the receiver; and control means for controlling operation of the apparatus, including means for selecting as a datum line for the determination of the levelling of the rails a line along the track in fixed vertical relation to a reference line between two of the transmitter, the receiver and the interference means; and means for adjusting the height of the other one of the transmitter, the receiver and the beam interference means in dependance on the cross levels of the track at the transmitter and the receiver to compensate for the selection.

* * * * *